US006918781B2

(12) United States Patent
Annecke

(10) Patent No.: US 6,918,781 B2
(45) Date of Patent: Jul. 19, 2005

(54) ELECTRICAL PLUG CONNECTOR

(75) Inventor: Alfred Annecke, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 10/611,864

(22) Filed: Jul. 3, 2003

(65) Prior Publication Data

US 2004/0005806 A1 Jan. 8, 2004

(30) Foreign Application Priority Data

Jul. 6, 2002 (DE) ..... 102 30 465

(51) Int. Cl.[7] ..... H01R 13/627
(52) U.S. Cl. ..... 439/350
(58) Field of Search ..... 439/350, 357, 439/358, 352

(56) References Cited

U.S. PATENT DOCUMENTS 5,314,345 A * 5/1994 Cahaly et al. ..... 439/188
6,435,894 B2 * 8/2002 Little et al. ..... 439/352
6,530,799 B2 * 3/2003 Regnier et al. ..... 439/352
6,663,411 B2 * 12/2003 Little ..... 439/352
6,705,886 B1 * 3/2004 Brown ..... 439/489

FOREIGN PATENT DOCUMENTS

| | | |
|---|---|---|
| DE | 195 13 358 | 9/1996 |
| DE | 198 40 726 | 9/2000 |
| DE | 100 05 959 | 9/2001 |
| DE | 101 51 95 | 9/2002 |
| EP | 0 791 987 | 9/1997 |
| EP | 1 006 621 | 6/2000 |
| EP | 1 130 692 | 9/2001 |

* cited by examiner

*Primary Examiner*—Ross Gushi
*Assistant Examiner*—Phuongchi Nguyen
(74) *Attorney, Agent, or Firm*—Blank Rome LLP

(57) ABSTRACT

The invention concerns an electrical plug connector with a housing having a housing body and a trunk projecting therefrom for receiving electrically connected contact elements for establishing contact with corresponding contact portions of an associated receptacle as well as with spring-acting catch arms on the trunk for making the housing fast in corresponding recesses of the receptacle.

15 Claims, 1 Drawing Sheet

10
12
13
14
14e
16
18
18o
18s
18v
20
22
22g
22w1
22w2
22o1
22o2
22o3
22w3
22s
24
26
50
52
56
58
60
62

ELECTRICAL PLUG CONNECTOR

BACKGROUND OF THE INVENTION

1. Field of the Invention

The invention concerns an electrical plug connector, in particular for use between a receptacle (ignitor) and an electrical control device for a restraint system in motor vehicles, by way of example an airbag.

2. Description of the Prior Art

A plug connector of the above type is found by way of example in DE 198 40 726 C2.

The very limited overall size (for example, length: 2 to 3 cm; width: approx. 1 cm; height: 0.1 to 1.0 cm) creates design problems.

This applies in particular with reference to a latching of plug and receptacle, with the contact elements of the components having to contact reliably in the locked state. In like manner, the plug and receptacle must not release from each other unintentionally.

In the case of the plug connector according to DE 198 40 726 C2, the problem is solved in that the locking element is situated in a pre-assembled starting position in a raised position against the effect of a spring, and in order to lock plug connector and receptacle, it can be brought against the effect of the spring into a maximum plug position in which the catch arms can be moved freely. After the latching of plug connector and receptacle, the locking element however moves as a result of the spring effect on its own back into its starting position in which the locking element then secures the catch arms against unintended release (so-called secondary locking).

It is apparent that as a result of the small overall size, the path of the spring is very short.

With the present invention, an alternative structural shape for a plug connector is to be offered that fulfills the following requirements: the locking element and the housing of the plug connector should be brought in one step into the end position (locking position with respect to the receptacle). In this function position, the plug connector should be secured against unintended release.

Typically, thus also in the case of the plug connector according to DE 198 40 726 C2, the plug connector has a housing with a housing body and a trunk projecting from it. The trunk serves to receive the electrically connected contact elements for making contact with the corresponding contact parts of the receptacle. The catch arms are linked to the housing body and run parallel to the trunk and with their free ends in the direction toward the trunk end. Upon being introduced into the receptacle, the front end of the catch arms in the direction of the plug contact run onto corresponding parts of the receptacle and are shifted "toward the interior," i.e. in the direction of the trunk. Upon further introduction of the plug connector into the receptacle, the catch arms finally spring back and into the locking position. In this locking position (function position) the catch arms are secured through the locking arms of the locking element (so-called secondary locking), with these locking arms filling the space between trunk and catch arm. This measure presupposes a corresponding tracking of the locking element.

SUMMARY OF THE INVENTION

The invention takes an opposite path. While the plug connector also comprises catch arms, they are at the end of the trunk, i.e., precisely the opposite in comparison with the state of the art. "At the end of the trunk" here means that the catch arms are linked "at the lower free end section" of the trunk, i.e., there can well be a space between the catch arms and the face of the trunk. From the point of linking, the catch arms run at a distance from the trunk (in order to permit the desired spring effect) in the direction toward the housing body.

This arrangement of the catch arms creates the possibility of arranging their "pivot point"/"center of gravity" in the direct vicinity of the linking zone. Expressed differently, a relatively long end section of the catch arms can be swung over a relatively wide area. At the same time, the latching point of the catch arms can be provided in the associated receptacle relatively close to the linking point. As a result of this measure, it is also possible to achieve secure latching of the plug connector in the receptacle even without means for secondary locking, in particular if the catch arms in their function/locking position run more or less parallel with each other (and thus in axial direction of the trunk).

This arrangement creates the further possibility of mounting a locking element fully on the housing of the plug connector and thus bringing housing and locking element at the same time into contact position with the receptacle. Because the locking element no longer has the function of creating a secondary locking for the catch arms of the housing after the locking of the housing in the receptacle, a relative shifting of housing and locking element during assembly becomes no longer necessary.

The locking element should nevertheless be (in like manner) locked with respect to the receptacle. In addition, it can fulfill the function of opening or closing a shunt in the area of the contact parts/contact elements of plug connector and receptacle. In addition it can be used to release the plug connector again from the locking position with respect to the receptacle.

Accordingly, the invention in its most general embodiment form concerns an electrical connector plug, in particular for use between a receptacle (ignitor) and an electrical control device for a restraint system in motor vehicles, with the following features:

- a housing with a housing body and a trunk projecting from it for receiving electrically connected contact elements for contacting with corresponding contact parts of the receptacle,
- catch arms on the trunk with spring action for fixing the housing in corresponding recesses of the receptacle,
- the catch arms are joined at the trunk end and from there run, at a distance from the trunk, in the direction toward the housing body,
- a locking element that can be plugged onto the housing,
- the locking element comprises locking arms with spring action for fastening to at least one of the elements receptacle and housing.

The locking arms of the locking element can project out from a base portion. This base portion can comprise a simple plate. From one or several edges of the plate, wall sections can project out resulting in a type of frame for the base portion.

The locking arms of the locking element can, in the connected condition of the locking element, pass in the area of the catch arms of the housing. Ordinarily the catch arms are arranged at two opposite sections of the trunk (thus offset by 180° with respect to each other). It is also possible for several catch arms to be arranged one beside the other on each side. If several catch arms are arranged on each side, the locking arms by way of example can be received between adjacent catch arms. The locking arms, however, can also be movable along slots that are formed in the catch arms.

It should be pointed out again at this point that the catch arms on the one hand and the locking arms on the other hand are arranged "inversely," specifically the catch arms in the area of the end of the trunk and the locking arms in the area of the housing body or of the connection area of the trunk to the housing body. When the locking element is plugged onto the housing, the free ends of the locking arms accordingly pass in the opposite direction to the free ends of the catch arms.

The described linking of the catch arms makes it possible to allow the catch arms in the function position to run from the plug connector and receptacle parallel to the trunk, with the exception, of course, of the connection area. If the catch means of the catch arms then are arranged in an area of the catch arms that is adjacent to the area at which the catch arms are linked to the end of the trunk, the possibility described above arises of situating the "pivot area" of the catch arms very far in the direction of the end of the trunk. Expressed differently: the area of the catch arms between the catch means and the housing body is greater than the area between the catch means and the joining parts.

As a result of the described arrangement of the pivot point toward the end of the trunk, the plug connector can no longer be removed from the receptacle without tools.

In order to nevertheless be able to separate plug connector and receptacle, one embodiment form of the invention provides that the locking member be arranged so as to be shifted relative to the housing, specifically in axial direction of the trunk. For this purpose, the locking member can be capable of being shifted along a path that is specified by a window that is formed in the locking element (in the example in the frame mentioned above).

The specific arrangement of the catch arms and of the locking arms creates the possibility of matching each to the other such that the catch means of the locking arms are fixed in the same recesses of the receptacle as the catch means of the catch arms.

If the catch means of the locking arms are arranged in the free end area of the locking arms (for example through corresponding thickenings), a further result is that, after the locking element has been fully plugged onto the housing, these catching means are situated approximately in the same place at which the catch arms have their catching means (by way of example external thickenings).

As mentioned earlier, the locking element can comprise a plug arm that has a length such that in the function position of housing and receptacle it opens a shunt that is effective between the contact parts and/or contact elements.

As a result of the parallel shifting of housing and locking element, the shunt thus also is released in a single work step upon assembly of plug connector and receptacle.

In this embodiment form, if the plug connector should become removed again out of the receptacle, the shunt can nevertheless be activated again before the housing is removed from the receptacle. For this purpose it is provided that the locking element can be shifted along a path that can be specified by a window which is formed in the locking element. The locking element is first withdrawn from the housing. In this process, the plug arm is also brought away and the shunt is activated. After reaching the maximum shift position, the locking element upon being further pulled away brings the housing with in that the catch arms are pushed away (pushed against each other) by the locking element whereby they are released from the recesses of the receptacle.

For guidance of the catch arms, the catch arms, in the function position of housing and receptacle, can engage with their free ends in openings that are formed in the locking element. The catch arms can then, upon the plug connector being pulled out of the receptacle, extend to the limits of these openings.

Further features of the invention are found in the features of the subclaims as well as the other application papers.

BRIEF DESCRIPTION OF THE DRAWINGS

The invention will be explained in greater detail below on the basis of an exemplary embodiment, with drawings showing the following in schematic representation.

DETAILED DESCRIPTION OF THE PREFERRED EMBODIMENTS

Figures 1, 2, 3, 4, 5, 6:
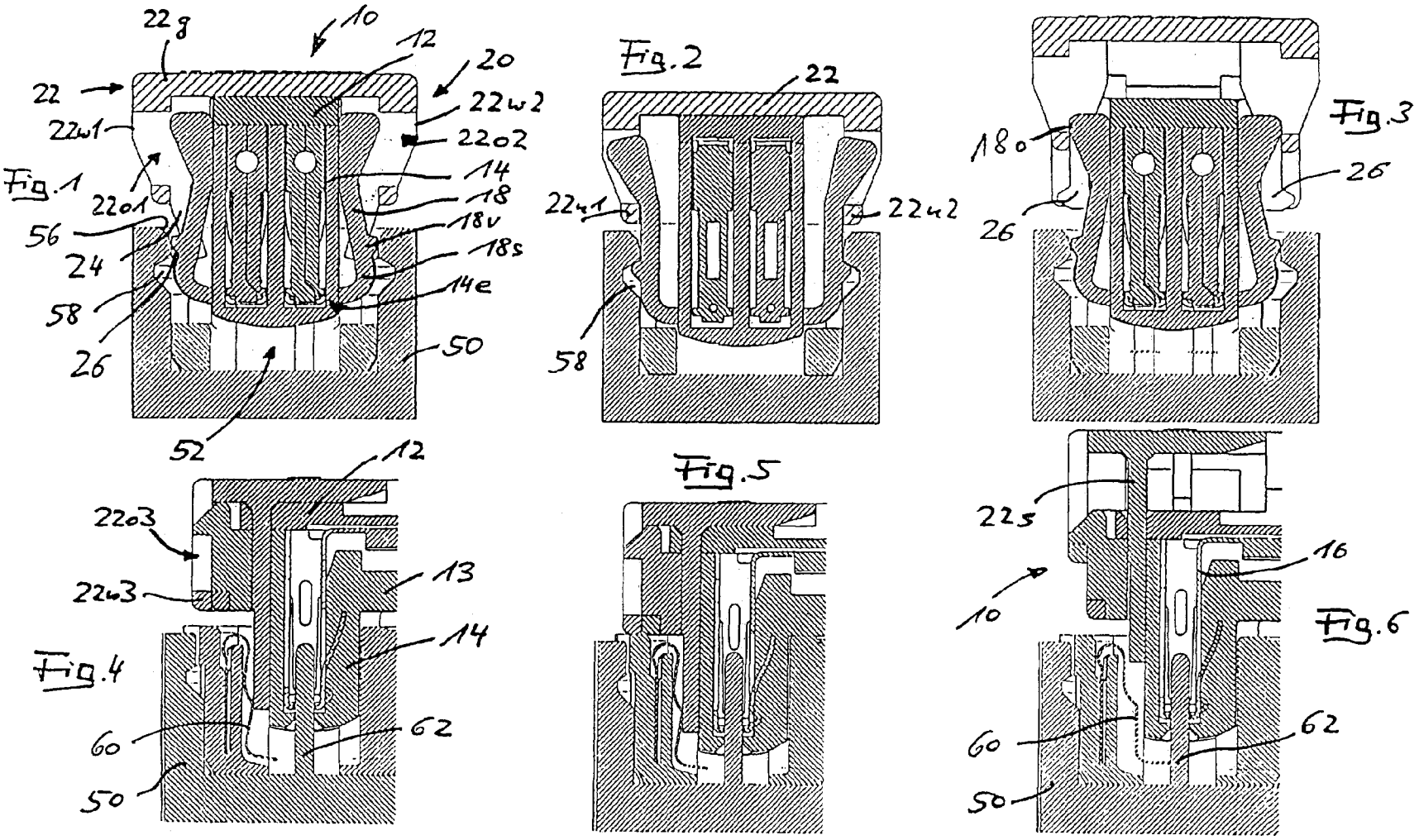
FIG. 1 shows a longitudinal section through a plug connector before its being latched in a receptacle.
FIG. 2 shows a view according to FIG. 1 with the plug connector and receptacle being latched.
FIG. 3 shows a view according to FIG. 1 with the plug connector being freed again from the receptacle.
FIG. 4 shows a longitudinal section offset by 90° to the depiction according to FIG. 1.
FIG. 5 shows a longitudinal section offset by 90° to the depiction according to FIG. 2.
FIG. 6 shows a longitudinal section offset by 90° to the depiction according to FIG. 3.

In FIG. 1, a plug connector is identified with 10 and an associated receptacle (ignitor) is designated with 50.

The plug connector comprises a two-part housing with one component of a housing upper shell being identified with 12 while 14 describes a trunk that is one piece with a housing lower shell 13 (FIG. 4).

The trunk serves to receive contact springs 16 (FIGS. 4 through 6) that can be electrically connected in known manner.

From free end section 14*e* of trunk 14, linked to sections situated opposite each other are respective catch arms 18 (in FIG. 1: at the lower end of trunk 14). Catch arms 18 extend in the depiction according to FIG. 1 upward (in the direction of upper shell 12 of the housing). Catch arms 18 have on the outside, shortly above a pivot area 18*s*, thickenings 18*v* which assume the function of a catch means.

In contact with upper shell 12 of the plug connector housing is a locking element 20. The locking element 20 comprises a base portion with a base plate 22*g*. Running vertically from base plate 22*g* are three wall surfaces that in FIG. 1 are identified with 22*w*1, 22*w*2 and in FIG. 4 are identified with 22*w*3, with a wall opening (window) 22*o*1, 22*o*2, 22*o*3 being provided in each wall surface opening (window).

Extending from wall surfaces 22*w*1, 22*w*2 essentially vertical to base plate 22*g* are locking arms 24. Arranged at the free ends of locking arms 24 on the outside are thickenings 26 which in FIG. 1 can be only partly discerned because they are hidden by catch arms 18.

Initially locking element 20 is plugged onto upper shell 12 of the housing body until base portion 22 lies on upper shell 12. Both are then introduced together into an opening 52 of the receptacle. As soon as thickenings 18*v* of catch arms 18 have come into contact with sloping surfaces 56 of the interior wall of receptacle 50, catch arms 18 pivot against trunk 14 (FIG. 1) and locking arms 24 are pressed away at the same time.

As soon as the thickenings 18*v* or 26 have reached corresponding recesses 58 on the inner wall of receptacle 50, catch arms 18 and locking arms 24 spring into these recesses 58. The locking position/function position of plug connector 10 and receptacle 50 is attained as is depicted in FIG. 2.

In this state, catch arms 18 extend for the most part parallel to trunk 14 (in axial direction of the trunk). Plug connector 10 no longer can be separated from receptacle 50. Pivot area 18*a* is so deep that if one tries to draw the plug connector housing out of the receptacle, the free ends of catch arms 18 push outward in opposite direction and thereby reinforce the latching even more.

Freeing of plug connector 10 from receptacle 50 is possible only with the aid of locking element 20. As depicted in FIG. 3, the latter is released from upper shell 12 of the housing body, with the maximum shift path being specified by means of the corresponding height of window 22*o*3. Locking arms 24 in this process are released from recesses 58, while catch arms 18 initially still remain in recesses 58. When locking element 20 is pulled out, catch arms are pressed away toward the interior (FIG. 3) as soon as lower limits 22*u*1, 22*u*2 of openings 22*o*1, 22*o*2 contact catch arms 18 thickened at their free end area 18*o*.

After this, plug connector 10 can be completely released from receptacle 50.

When locking element 20 is drawn out, a short circuit 60 at the same time is again activated, i.e., is brought against contact pins 62 in the area of receptacle 50, with short circuit 60 being configured as a leaf spring. It can be seen from FIG. 6 how said short circuit 60 is canceled upon insertion of locking element 20 specifically in that a plug-in arm 22*s* that projects vertically from base plate 22*g* is brought against short circuit 60 and presses it away laterally (and thus releases it from contact pins 62).

What is claimed is:

1. An electrical plug connector, in particular for use between a receptacle (ignitor) and an electrical control device for a restraint system in motor vehicles, comprising:

a housing having a housing body and a trunk projecting therefrom for receiving electrically connected contact elements for the purpose of contacting corresponding contact parts of the receptacle;

catch arms with spring effect on the trunk for fixing the housing in corresponding recesses of the receptacle, the catch arms are joined at the end of the trunk and from there pass, at a distance from the trunk, in the direction toward the housing body; and a locking element that can be plugged onto the housing, the locking element comprises spring-acting locking arms for making fast to at least one of the elements receptacle or housing, wherein the locking element is used to release the plug connector from a locking position with respect to the receptacle, and deflecting the locking arms simultaneously deflects the catch arms.

2. A plug connector according to claim 1, in which the locking arms of the locking element project out from a base portion.

3. A plug connector according to claim 1, in which the base portion is configured as a kind of frame.

4. A plug connector according to claim 1, in which the locking arms of the locking element, in plugged condition of the locking element, extend into the area of the catch arms of the housing.

5. A plug connector according to claim 1, in which the locking arms of the locking element are movable along slots that are formed in the catch arms.

6. A plug connector according to claim 1, in which the catch arms in the locking position of the plug connector and receptacle run parallel to the trunk.

7. A plug connector according to claim 1, in which the catch arms and the locking arms are configured such that in the function position of plug connector and receptacle are made fast in the same recesses of the receptacle.

8. A plug connector according to claim 1, in which the locking element in its complete plug position with respect to the housing can be plugged with the housing onto the receptacle.

9. A plug connector according to claim 1, in which the locking element can be shifted in relation to the housing in the axial direction of the trunk.

10. A plug connector according to claim 1, in which the locking element can be shifted along a path that is specified by a window formed in the locking element.

11. A plug connector according to claim 1, in which the catch arms, in the function position of housing and receptacle, engage with their free ends in openings which are formed in the locking element.

12. A plug connector according to claim 1, wherein only the locking element is actuated to release the catch arms from the recesses of the receptacle.

13. A plug connector according to claim 1, wherein the locking element engages the recesses of the receptacle when the plug connector is in the locking position.

14. A plug connector according to claim 1, in which catch means of the catch arms are arranged in an area of the catch arms which is adjacent to an area at which the catch arms are joined to a trunk end.

15. A plug connector according to claim 14, in which the catch means of the locking arms are arranged in a free end area of the locking arms.

* * * * *